United States Patent [19]

Wong

[11] Patent Number: 4,899,027

[45] Date of Patent: Feb. 6, 1990

[54] DOUBLE-EFFECT TABLE WITH HEATING AND COOLING PURPOSES

[76] Inventor: Jackson Wong, No. 14, Li-Chih New Village, Tso-Ying District, Kaohsiung City, Taiwan

[21] Appl. No.: 355,340

[22] Filed: May 22, 1989

[51] Int. Cl.[4] ..... H05B 6/12

[52] U.S. Cl. ..... 219/10.493; 219/10.67; 219/218; 312/236

[58] Field of Search ..... 219/10.493, 10.67, 10.75, 219/218, 10.55 RE; 312/236

[56] References Cited

U.S. PATENT DOCUMENTS

| | | | |
|---|---|---|---|
| 2,662,966 | 12/1953 | Bruchhausen | 219/218 X |
| 3,740,513 | 6/1973 | Peters, Jr. et al. | 219/10.493 |
| 4,034,200 | 7/1977 | Visagie | 219/218 |
| 4,038,518 | 7/1977 | Morton et al. | 219/218 |
| 4,349,713 | 9/1982 | Marsen | 219/218 X |
| 4,665,893 | 5/1987 | Miyagawa et al. | 219/10.67 X |

*Primary Examiner*—Philip H. Leung

[57] ABSTRACT

A double-effect table, especially a dining table includes a cooling fan formed in a foot stand supporting an upper table plate for blowing cooling air radially outwardly for evenly cooling people sitting around the table, and an electromagnetic oven capable of producing electromagnetic waves for heating or cooking purpose embedded in a central portion of the upper table plate for conveniently heating or cooking food or beverage directly on the upper table plate of the table.

1 Claim, 1 Drawing Sheet

DOUBLE-EFFECT TABLE WITH HEATING AND COOLING PURPOSES

BACKGROUND OF THE INVENTION

When people are sitting around a conventional dining table served with hot foods, people may feel very hot and uncomfortable when eating the hot foods. If electric fan is provided for cooling down the hot temperature caused by an oven or hot foods laid on the dining table, the fan can not homogeneously cool the people around the table unless a plurality of fans are provided aside the people. So many fans thus provided may occupy a great space and influence the activities or movements of the people and the waiters, causing inconvenience and uncomfortableness to the people.

A conventional oven for heating food may be put on a round table, which stands a height above a table surface to possibly influence an esthetic appearance of the table or obstruct a cooking operation done on the table surface.

The present inventor has found the drawbacks of the conventional dining table and invented the present table with both heating and cooling effects.

SUMMARY OF THE INVENTION

The object of the present invention is to provide a table having an electromagnetic oven embedded in a table plate coplanar to an upper surface of the table plate for convenient heating purpose and having a cooling fan formed in a foot stand supporting the table plate under the table plate for blowing cooling air laterally for cooling people sitting around the table.

DETAILED DESCRIPTION

Figure 1:
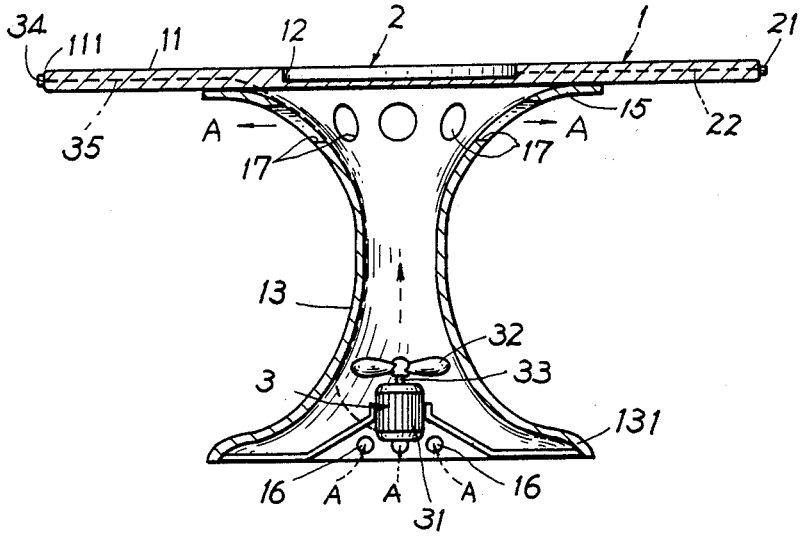
FIG. 1 is a partial sectional drawing of the present invention.
Figure 2:
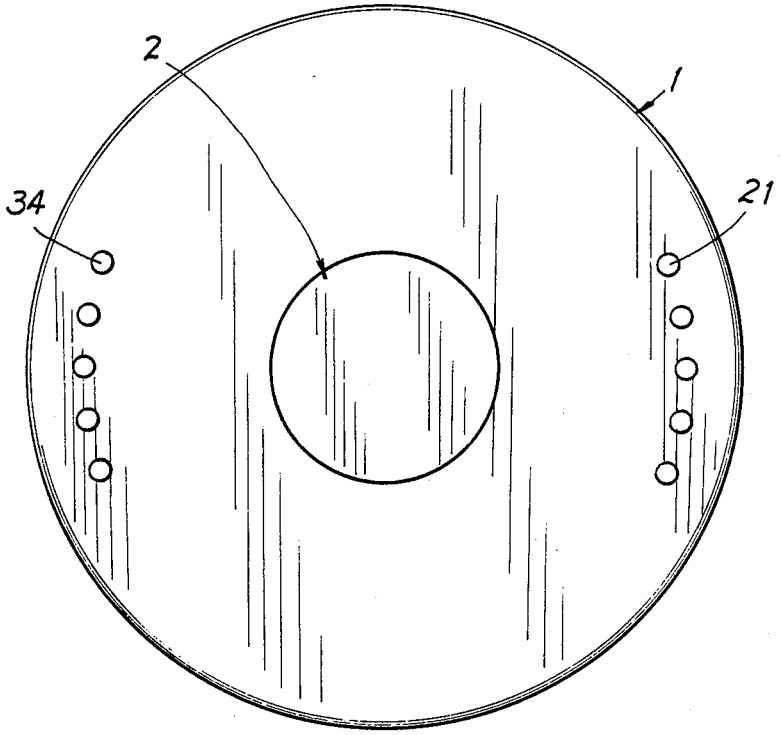
FIG. 2 is a top view of another embodiment oof the present invention.

As shown in FIGS. 1 and 2, the present invention comprises: a table means 1 particularly for dining use, an electromagnetic oven 2, and a cooling fan 3.

The table means 1 includes an upper table plate 11 having a central recess 12 recessed in a central portion of the table plate 11, and a hollow foot stand 13 formed under the upper table plate 11. The stand 13 is formed with a base portion 131 standing on a floor which is enlarged downwardly from the stand 13.

The electromagnetic oven 2 is engageably mounted (or embedded) in the central recess 12 on the upper table plate 11. Several push buttons 21 are provided on a perimeter 111 of the upper table plate 11 (FIG. 1) or on a top surface (FIG. 2) of the table plate 11 which are connected to the oven 2 by electric wires 22 for adjustably controlling a heating temperature of the oven. As shown in FIG. 2, the push buttons 21 can be formed on the table plate 11 coplanar to an upper surface of the table plate 11 for esthetic meaning. The electromagnetic oven 2 may produce electromagnetic waves for heating or cooking foods when laid on the oven 2 (not shown).

The cooling fan 3 includes: a driving motor 31 mounted on a lower portion in the foot stand 13, a fan blade 32 mounted on a shaft 33 rotatably vertically mounted in the motor 31 as shown in FIG. 1, and several push buttons 34 formed on the table plate 11 for controlling the on-off operation of the motor 31 or the driving speed of the motor 31, connected with the motor 31 by electric wires 35 as shown in dotted line of FIG. 1. The push buttons 34 may also be coplanar to the upper surface of the table plate 11. The push buttons 34 and 21 may be made of pressure-sensitive touching switches having flat surface for their smooth operation and esthetic meaning.

Several air inlet holes 16 are formed in a lower portion of the base portion 131 of the hollow stand 13, and several air discharge holes 17 are formed in an upper portion 15 of the stand 13. The upper portion 15 of the stand 13 can be enlarged upwardly to connect the upper table plate 11 for supporting the table plate 11.

When driving the motor 31 and fan blade 32, a cooling air A is directed through inlet holes 16 and discharged through discharge holes 17 for cooling the people sitting around the table (not shown).

The present invention may have the following advantages superior to a conventional table:

1. The electromagnetic oven 2 is directly embedded in a central recess 12 of the upper table plate 11 so that food as kept in a dish, a bowl or a tray may be directly put on the oven (coplanar to an upper surface of the table plate) for convenient cooking or heating purpose. For heating coffee or other beverage, a metal cup of coffee may also directly put on the oven (or just put on the central portion of the table plate 11 corresponding to a position of the oven 2) for quicker preparation of a hot coffee drink. No obstruction of the cooking utensil or beverage container will be caused on the table since the oven 2 is recessed in the table plate and coplanar to the upper surface of the table plate.

2. The cooling fan 3 is provided in the foot stand 13 without further occupying a space. The cooling air blown from the discharge holes 17 radially disposed in an upper portion of the foot stand may be evenly supplied towards any person sitting aside the table, so that a comfortable feeling will be felt and a cooling environment will be achieved when people sitting around the table.

The shape of the upper table plate 11 is not limited in this invention. The foot stand 13 is also not limited in this invention 1 of which the base portion 131 can be made as a trifurcate or a quadrifid for standing the table on a floor.

What is claimed is:

1. A double-effect table comprising:

an upper table plate having an electromagnetic oven capable of producing electromagnetic waves for heating or cooking purpose embedded in the upper table plate, coplanar to an upper surface of said upper table plate;

a hollow foot stand positioned under said upper table plate having an upper portion of said foot stand enlarged upwardly for connecting and supporting said upper table plate and having a lower portion of said foot stand enlarged downwardly for standing said foot stand and said table on a floor; and a cooling fan provided in said foot stand operatively driven for discharging air radially outwardly from said foot stand, the improvement which comprises:

said hollow foot stand having said lower portion formed with a plurality of air inlet holes, and having said upper portion of said stand formed with a plurality of air discharge holes radially disposed and transversely formed through said upper portion of said hollow foot stand, said driving motor and said cooling fan mounted in said lower portion of said foot stand, whereby upon a running of the driving motor and cooling fan, a cooling air is sucked from the lower portion of said foot stand, and directed through said hollow foot stand to be discharged from the upper portion of said foot stand for evenly cooling people sitting around said table.

* * * * *